US012590509B2

(12) United States Patent
Lang

(10) Patent No.: US 12,590,509 B2
(45) Date of Patent: Mar. 31, 2026

(54) AUTOMATED IDENTIFICATION OF WELL TARGETS IN RESERVOIR SIMULATION MODELS

(71) Applicant: Schlumberger Technology Corporation, Sugar Land, TX (US)

(72) Inventor: Philipp Stefan Lang, Abingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1007 days.

(21) Appl. No.: 17/753,746

(22) PCT Filed: Sep. 14, 2020

(86) PCT No.: PCT/US2020/070537
§ 371 (c)(1),
(2) Date: Mar. 14, 2022

(87) PCT Pub. No.: WO2021/051140
PCT Pub. Date: Mar. 18, 2021

(65) Prior Publication Data

US 2022/0372846 A1 Nov. 24, 2022

Related U.S. Application Data

(60) Provisional application No. 62/900,021, filed on Sep. 13, 2019.

(51) Int. Cl.
*E21B 41/00* (2006.01)

(52) U.S. Cl.
CPC ..... *E21B 41/00* (2013.01); *E21B 2200/20* (2020.05)

(58) Field of Classification Search
CPC ..... E21B 41/00; E21B 2200/20
USPC ..... 703/1
See application file for complete search history.

(56) References Cited

U.S. PATENT DOCUMENTS

| | | | | |
|---|---|---|---|---|
| 8,775,141 | B2 * | 7/2014 | Raphael | E21B 47/00 703/10 |
| 9,921,338 | B2 * | 3/2018 | Embid Droz | G01V 20/00 |
| 10,007,015 | B2 * | 6/2018 | Gray | G01V 1/308 |
| 10,450,860 | B2 * | 10/2019 | Polyakov | E21B 49/00 |
| 10,605,053 | B2 * | 3/2020 | Fornel | E21B 7/00 |
| 12,018,559 | B2 * | 6/2024 | Fries | E21B 47/12 |
| 2008/0306803 | A1 * | 12/2008 | Vaal | E21B 43/00 705/7.22 |

(Continued)

OTHER PUBLICATIONS

Tolomei et al. (Interpretable Predictions of Tree-based Ensembles via Actionable Feature Tweaking, ACM, 2017, pp. 1-10). (Year: 2017).*

(Continued)

*Primary Examiner* — Iftekhar A Khan
(74) *Attorney, Agent, or Firm* — Kyle R. Miiller

(57) ABSTRACT

A system and method are provided for identifying a wellsite target for drilling, including receiving a plurality of data regarding a wellsite, generating a distribution of reservoir properties using the plurality of data for an area of a reservoir defined within the wellsite, determining at least one opportunity index for an area in the reservoir based on at least one of the corresponding reservoir properties, classifying a section of the reservoir based on at least one computed embedding space, wherein the at least one computed embedding space of the section is based on the at least one opportunity index.

19 Claims, 8 Drawing Sheets

(56) References Cited

U.S. PATENT DOCUMENTS

| | | | | |
|---|---|---|---|---|
| 2009/0119018 | A1* | 5/2009 | Priezzhev | G06N 3/02 702/11 |
| 2009/0152005 | A1* | 6/2009 | Chapman | E21B 44/00 702/9 |
| 2013/0110483 | A1* | 5/2013 | Chugunov | G01V 20/00 703/10 |
| 2014/0365183 | A1* | 12/2014 | Embid Droz | E21B 41/00 703/1 |
| 2016/0003008 | A1* | 1/2016 | Uribe | E21B 43/30 166/250.01 |
| 2016/0290129 | A1* | 10/2016 | Chorn | E21B 41/00 |
| 2018/0240021 | A1* | 8/2018 | Al-Harbi | G06N 3/0499 |
| 2019/0010789 | A1* | 1/2019 | Beato | E21B 49/087 |
| 2019/0271211 | A1* | 9/2019 | Mustapha | G06F 17/11 |
| 2024/0110469 | A1* | 4/2024 | Mustapha | G06F 30/27 |

OTHER PUBLICATIONS

Hall et al. (Choice of Neighbor Order in Nearest-Neighbor Classification, Institute of Mathematical Statistics, 2008, pp. 1-19) (Year: 2008).*

Saputra et al. (Simulation Opportunity Index, A Simple and Effective Method to Boost the Hydrocarbon Recovery, SPE, 2016, pp. 1-17) (Year: 2016).*

Ghazali et al. ( Optimizing Development Strategy and Maximizing Field Economic Recovery through Simulation Opportunity Index, SPE, 2011, pp. 1-6) (Year: 2011).*

Mustapha, H. M. et al., "Well Placement Optimization Under Uncertainty Using Opportunity Indexes Analysis and Probability Maps", 16th European Conference on the Mathematics of Oil Recovery held in Barcelona Spain, 2018, 16 pages.

Karkevandi-Talkhooncheh, A. et al., "Applicaton of hybrid adaptive neuro-fuzzy inference system in well placement optimization", Journal of Petroleum Science and Engineering, 2018, 166, pp. 924-947.

Saputra, W. , "Simulation Opportunity Index, A Simple and Effective Method to Boost the Hydrocarbon Recovery", SPE-184501-STU, prepared for presentation at the SPE International Studen Paper Contest at the SPE Annual Technical Conference and Exhibition, Dubai, UAE, 2016, 17 pages.

Saputra, W., "A Cost-Effective Method to Maximize the Hydrocarbon Recovery by Optimizing the Vertical Well Placements through the Simulation Opportunity Index", SPE-182803-MS, prepared for presentation at the SPE Kingdom of Saudi Arabia Annual Technical Symposium and Exhibition, Dammam, Saudi Arabia, 2016, 20 pages.

Al-Khazraji, A. K. et al., "Development of Heterogeneous Immature Brownfield with Waterdrive Using Dynamic Opportunity Index: A Case Study from Iraqi Oilfields", SPE-175708-MS, prepared for presentation at the SPE North Africa Technical Conference and Exhibition, Cairo, Egypt, 2015, 13 pages.

* cited by examiner

AUTOMATED IDENTIFICATION OF WELL TARGETS IN RESERVOIR SIMULATION MODELS

CROSS-REFERENCE TO RELATED APPLICATION(S)

The present disclosure is a national stage entry under 35 U.S.C. § 371 of International Application No. PCT/US2020/070537, filed on Sep. 14, 2020, which claims priority from U.S. Provisional Application No. 62/900,021, filed on Sep. 13, 2019, entitled "Automated Identification of Well Targets in Reservoir Simulation Models" herein incorporated by reference in its entirety.

BACKGROUND

Currently, well target identification is mainly driven by expert knowledge. Once such experts leave an organization, so does their expertise. Identifying well targets for a large number of realizations in uncertainty and optimization workflows may be a very time-consuming task to perform manually. The reasoning behind expert-identified well locations may not be easily obtainable, thus making knowledge sharing difficult. A new approach to identifying well targets in a faster, less labor intensive, more comprehensive, and automated manner is desirable.

BRIEF DESCRIPTION OF THE DRAWINGS

For a better understanding of the aforementioned embodiments as well as additional embodiments thereof, reference should be made to the Detailed Description below, in conjunction with the following drawings in which like reference numerals refer to corresponding parts throughout the figures.

SUMMARY

Figure 1A:
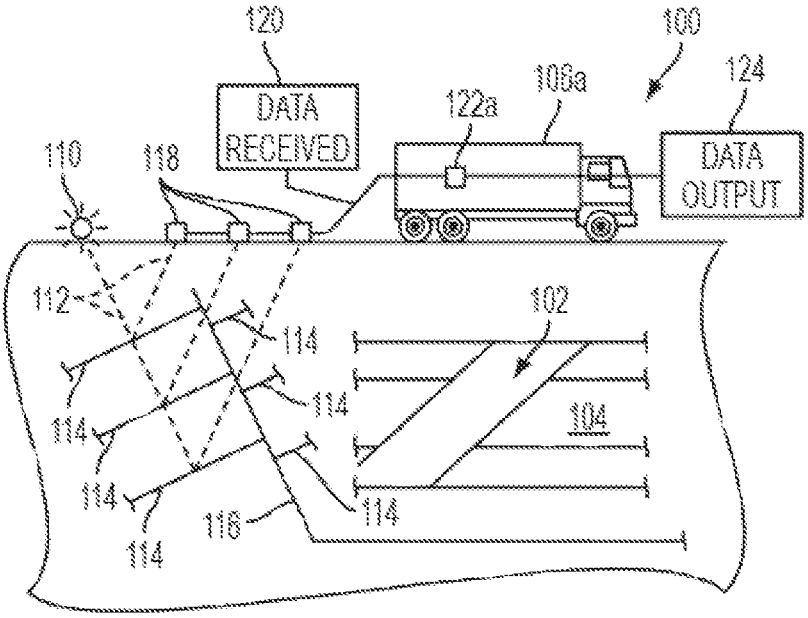
FIG. 1A illustrates a simplified schematic view of a survey operation performed by a survey tool at an oil field, in accordance with some embodiments.

According to one aspect of the present disclosure, a method for identifying a wellsite target for drilling is provided. The method includes receiving a plurality of data regarding a wellsite. Also, the method includes generating a distribution of reservoir properties using the plurality of data for an area of a reservoir defined within the wellsite. Moreover, the method includes determining at least one opportunity index for the area in the reservoir based on at least one of the corresponding reservoir properties. Furthermore, the method includes classifying a section of the reservoir based on at least one computed embedding space, wherein the at least one computed embedding space of the section is based on the at least one opportunity index.

According to another aspect of the present disclosure, a system is provided that includes a processor that is configured to generate a distribution of reservoir properties using a plurality of data for an area of a reservoir defined within the wellsite. Also, the processor is configured to determine at least one opportunity index for an area in the reservoir based on at least one of the corresponding reservoir properties. Furthermore, the processor is configured to classify a section of the reservoir based on at least one computed embedding space, wherein the at least one computed embedding space of the section is based on the at least one opportunity index.

According to another aspect of the present disclosure, a method for developing information regarding a wellsite target for drilling is provided. The method includes receiving a plurality of data regarding a wellsite. Moreover, the method includes developing a distribution of reservoir properties for an area of a reservoir defined within the wellsite. Also, the method includes utilizing a first model to determine at least one opportunity index for an area in the reservoir based on at least one of the corresponding reservoir properties. Furthermore, the method includes employing a second model to classify a section of the reservoir based on at least one computed embedding space, wherein the at least one computed embedding space of the section is based on the at least one opportunity index.

Additional features and advantages of the present disclosure are described in, and will be apparent from, the detailed description of this disclosure.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the principles of the present disclosure may be practiced without these specific details. In other instances, well-known methods, procedures, components, circuits and networks have not been described in detail so as not to unnecessarily obscure aspects of the embodiments.

It will also be understood that, although the terms first, second, etc., may be used herein to describe various elements, these elements should not be limited by these terms. These terms are used to distinguish one element from another. For example, a first object or step could be termed a second object or step, and, similarly, a second object or step could be termed a first object or step, without departing from the scope of the present disclosure. The first object or step, and the second object or step, are both objects or steps, respectively, but they are not to be considered the same object or step.

The terminology used in the description herein is for the purpose of describing particular embodiments and is not intended to be limiting. As used in the description herein and the appended claims, the singular forms "a," "an" and "the" are intended to include the plural forms as well, unless the context clearly indicates otherwise. It will also be understood that the term "and/or" as used herein refers to and encompasses any possible combination of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context.

Those with skill in the art will appreciate that while some terms in this disclosure may refer to absolutes, e.g., all source receiver traces, each of a plurality of objects, etc., the methods and techniques disclosed herein may also be performed on fewer than all of a given thing, e.g., performed on one or more components and/or performed on one or more source receiver traces. Accordingly, in instances in the disclosure where an absolute is used, the disclosure may also be interpreted to be referring to a subset.

The computing systems, methods, processing procedures, techniques and workflows disclosed herein are more efficient and/or effective methods for identifying, isolating, transforming, and/or processing various aspects of data that is collected in an oilfield context. The described methods and apparatus provide a new technological solution to the petroleum engineering problems described herein. Embodiments are directed to new and specialized processing apparatus and methods of using the same. Integrity determination according to the present application implicates a new processing approach (e.g., hardware, special purpose processors, and specially programmed general-purpose processors) because such analyses are too complex and cannot be done by a person in the time available or at all. Thus, the apparatus and method of the claims are directed to tangible implementations or solutions to a specific technological problem in the oilfield context.

The optimization of well placement may be considered np-hard, and approximate solutions may be used for certain practical implementations. Approaches to finding approximate solutions differ mostly along a spectra of trade-offs. These trade-offs may relate to requirements with respect to input data, computational resources, and/or the expected degree of accuracy.

The present disclosure is directed to an automated system and method for identifying potential well targets in a reservoir simulation model. The techniques described herein use knowledge of experts to identify the characteristics of good well targets, and/or continuously improve an automated model for identifying potential well targets. For example, expert knowledge may be captured continuously and included into a servable model. This way, expert knowledge may be transferred from an individual to the organization, making expert knowledge servable. The model may be applied at scale and/or in as many realizations as needed. The model may be inspectable and may make expert assumptions explicit. The techniques described herein may be data-based and/or predict well targets as regions in comparison to well paths. An advantage of the present disclosure is that real time inference, e.g., for web applications, is supported, and thus the method described herein may be computationally advantageous in inference time.

The principles described herein may be utilized in multiple applications such as automated highlighting of regions of interest for well placement, ranking competing well targets, recommending well targets for a reservoir simulation model, well placement for ensemble models (e.g., uncertainty and optimization workflows), and in complex reservoir structures. The principles disclosed herein may be combined with a computing system to provide an integrated and practical application to improve automated identification of well targets.

Figure 1B:
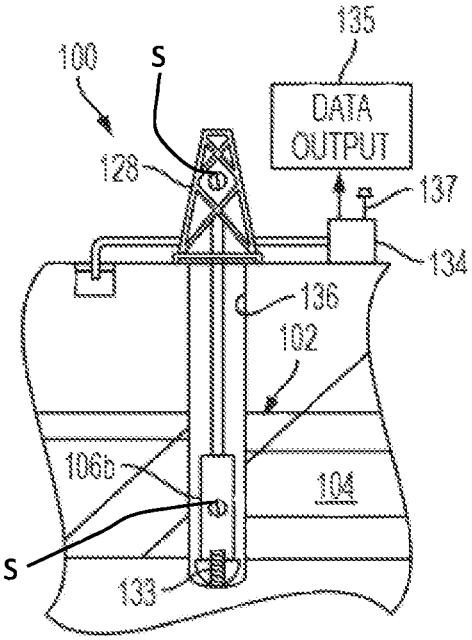
FIG. 1B illustrates a simplified schematic view of a drilling operation performed by drilling tools, in accordance with some embodiments.
Figure 1C:
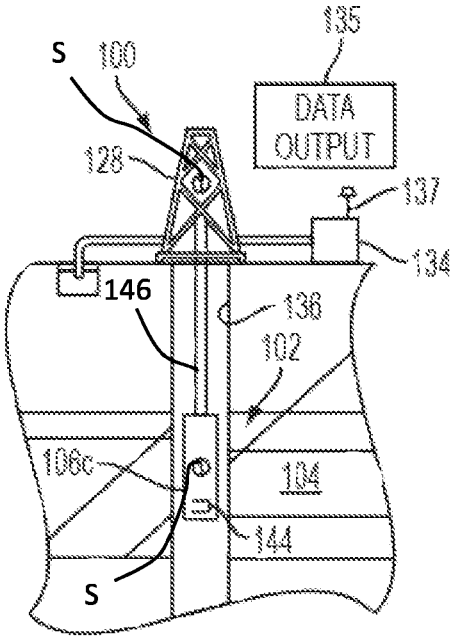
FIG. 1C illustrates a simplified schematic view of a production operation performed by a production tool, in accordance with some embodiments.

FIGS. 1A-1C illustrate simplified, schematic views of oilfield 100 having subterranean formation 102 containing reservoir 104 therein in accordance with implementations of various technologies and techniques described herein. FIG. 1A illustrates a survey operation being performed by a survey tool, such as seismic truck **106*a*, to measure properties of the subterranean formation. The survey operation is a seismic survey operation for producing sound vibrations. In FIG. 1A, one such sound vibration, e.g., sound vibration 112 generated by source 110, reflects off horizons 114 in earth formation 116. A set of sound vibrations is received by sensors, such as geophone-receivers 118, situated on the earth's surface. The data received 120 is provided as input data to a computer 122*a* of the seismic truck 106*a*, and responsive to the input data, computer 122*a* generates seismic data output 124**. This seismic data output may be stored, transmitted or further processed as desired, for example, by data reduction.

FIG. 1B illustrates a drilling operation being performed by drilling tools **106*b* suspended by rig 128 and advanced into subterranean formations 102 to form wellbore 136. The drilling tools are advanced into subterranean formations 102 to reach reservoir 104. Each well may target one or more reservoirs. The drilling tools may be adapted for measuring downhole properties using logging while drilling tools. The logging while drilling tools may also be adapted for taking core sample 133** as shown.

The drilling tool **106*b*** may include downhole sensor S adapted to perform logging while drilling (LWD) data collection. The sensor S may be any type of sensor.

Computer facilities may be positioned at various locations about the oilfield 100 (e.g., the surface unit 134) and/or at remote locations. Surface unit 134 may be used to communicate with the drilling tools and/or offsite operations, as well as with other surface or downhole sensors. Surface unit 134 is capable of communicating with the drilling tools to send commands to the drilling tools, and to receive data therefrom. Surface unit 134 may also collect data generated during the drilling operation and produce data output 135, which may then be stored or transmitted.

In some embodiments, sensors (S), such as gauges, may be positioned about oilfield 100 to collect data relating to various oilfield operations as described previously. As shown, sensor (S) is positioned in one or more locations in the drilling tools and/or at rig 128 to measure drilling parameters, such as weight on bit, torque on bit, pressures, temperatures, flow rates, compositions, rotary speed, and/or other parameters of the field operation. In some embodiments, sensors (S) may also be positioned in one or more locations in the wellbore 136.

Drilling tools **106*b* may include a bottom hole assembly (BHA) (not shown), generally referenced, near the drill bit (e.g., within several drill collar lengths from the drill bit). The bottom hole assembly includes capabilities for measuring, processing, and storing information, as well as communicating with surface unit 134**. The bottom hole assembly further includes drill collars for performing various other measurement functions.

The bottom hole assembly may include a communication subassembly that communicates with surface unit 134. The communication subassembly is configured to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured drilling parameters. It will be appreciated by one of skill in the art that a variety of telemetry systems may be employed, such as wired drill pipe, electromagnetic or other known telemetry systems.

The data gathered by sensors (S) may be collected by surface unit 134 and/or other data collection sources for analysis or other processing. An example of the further processing is the generation of a grid for use in the computation of a juxtaposition diagram as discussed below. The data collected by sensors (S) may be used alone or in combination with other data. The data may be collected in one or more databases and/or transmitted on or offsite. The data may be historical data, real time data, or combinations thereof. The real time data may be used in real time, or stored for later use. The data may also be combined with historical data or other inputs for further analysis. The data may be stored in separate databases, or combined into a single database.

Surface unit 134 may include transceiver 137 to allow communications between surface unit 134 and various portions of the oilfield 100 or other locations. Surface unit 134 may also be provided with or functionally connected to one or more controllers (not shown) for actuating mechanisms at oilfield 100. Surface unit 134 may then send command signals to oilfield 100 in response to data received. Surface unit 134 may receive commands via transceiver 137 or may itself execute commands to the controller. A processor may be provided to analyze the data (locally or remotely), make decisions and/or actuate the controller.

FIG. 1C illustrates a production operation being performed by production tool 106*c* deployed by rig 128 having a Christmas tree valve arrangement into completed wellbore 136 for drawing fluid from the downhole reservoirs into rig 128. The fluid flows from reservoir 104 through perforations in the casing (not shown) and into production tool 106*c* in wellbore 136 and to rig 128 via gathering network 146.

In some embodiments, sensors (S), such as gauges, may be positioned about oilfield 100 to collect data relating to various field operations as described previously. As shown, the sensors (S) may be positioned in production tool 106*c* or rig 128.

While FIGS. 1B-1C illustrate tools used to measure properties of an oilfield, it will be appreciated that various measurement tools capable of sensing parameters, such as seismic two-way travel time, density, resistivity, production rate, etc., of the subterranean formation and/or its geological formations may be used. As an example, wireline tools may be used to obtain measurement information related to casing attributes. The wireline tool may include a sonic or ultrasonic transducer to provide measurements on casing geometry. The casing geometry information may also be provided by finger caliper sensors that may be included on the wireline tool. Various sensors may be located at various positions along the wellbore and/or the monitoring tools to collect and/or monitor the desired data. Other sources of data may also be provided from offsite locations.

The field configurations of FIGS. 1A-1C are intended to provide a brief description of an example of a field usable with oilfield application frameworks. Identification of well targets according to the present disclosure may take place in this context. Part, or all, of oilfield 100 may be on land, water, and/or sea. Also, while a single field measured at a single location is depicted, oilfield applications may be utilized with any combination of one or more oilfields, one or more processing facilities and one or more wellsites. An example of processing of data collected by the sensors is the generation of a grid for use in the computation of a juxtaposition diagram as discussed below.

Figure 2:
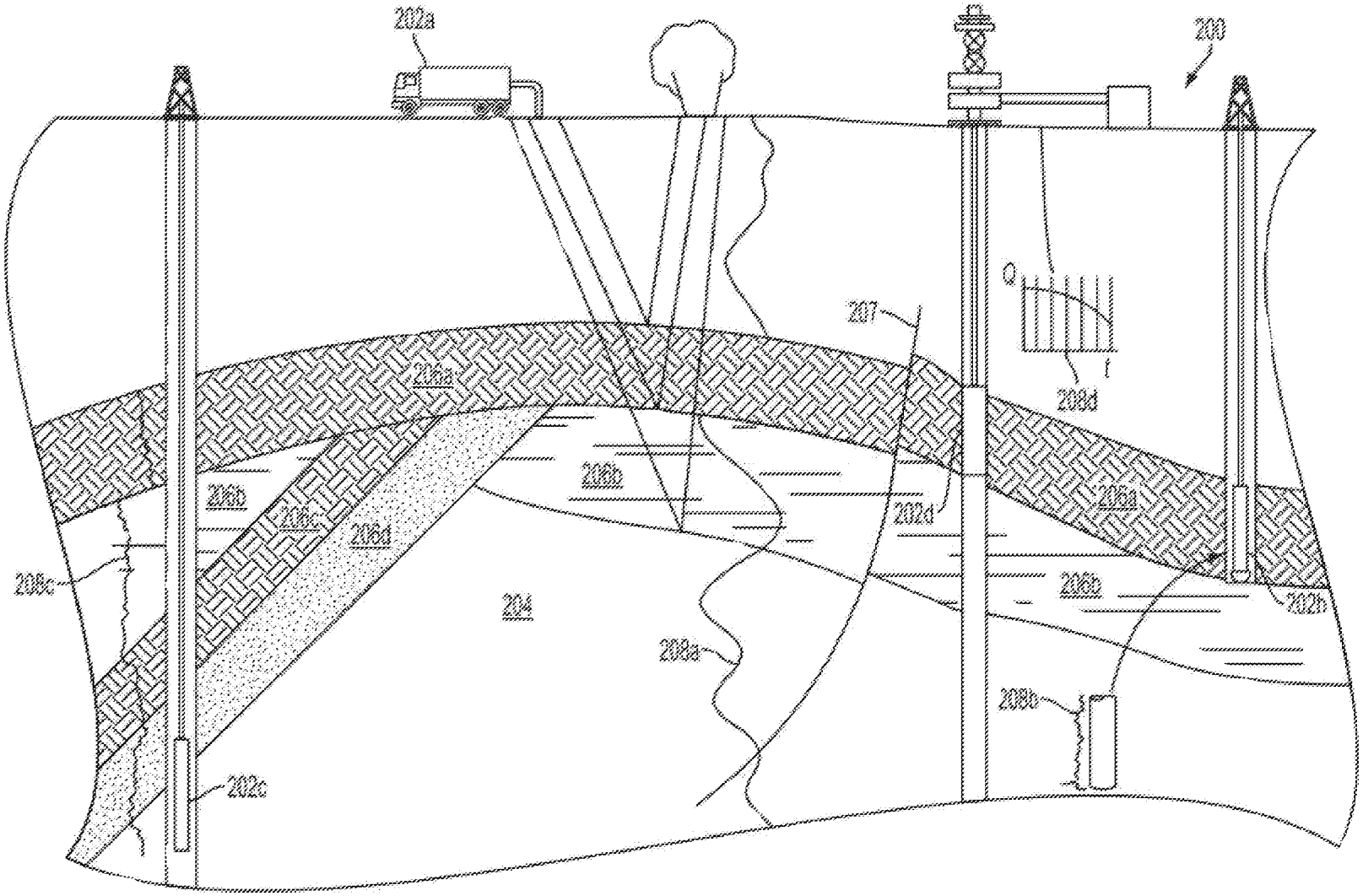
FIG. 2 illustrates a schematic view, partially in cross section, of an oilfield, in accordance with some embodiments.

FIG. 2 illustrates a schematic view, partially in cross section of oilfield 200 having data acquisition tools 202*a*, 202*b*, 202*c* and 202*d* positioned at various locations along oilfield 200 for collecting data of subterranean formation 204 in accordance with implementations of various technologies and techniques described herein. Data acquisition tools 202*a*-202*d* may be the same as data acquisition tools 106*a*-106*d* of FIGS. 1A-1C, respectively, or others not depicted. As shown, data acquisition tools 202*a*-202*d* generate data plots or measurements 208*a*-208*d*, respectively. These data plots are depicted along oilfield 200 to demonstrate the data generated by the various operations.

Data plots 208*a*-208*c* are examples of static data plots that may be generated by data acquisition tools 202*a*-202*c*, respectively; however, it should be understood that data plots 208*a*-208*c* may also be data plots that are updated in real time. These measurements may be analyzed to better define the properties of the formation(s) and/or determine the accuracy of the measurements and/or for checking for errors. The plots of each of the respective measurements may be aligned and scaled for comparison and verification of the properties.

Static data plot 208*a* is a seismic two-way response over a period of time. Static plot 208*b* is core sample data measured from a core sample of the formation 204. The core sample may be used to provide data, such as a graph of the density, porosity, permeability, or some other physical property of the core sample over the length of the core. Tests for density and viscosity may be performed on the fluids in the core at varying pressures and temperatures. Static data plot 208*c* is a logging trace that provides a resistivity or other measurement of the formation at various depths.

A production decline curve or graph 208*d* is a dynamic data plot of the fluid flow rate over time. The production decline curve provides the production rate as a function of time. As the fluid flows through the wellbore, measurements are taken of fluid properties, such as flow rates, pressures, composition, etc.

Other data may also be collected, such as historical data, user inputs, economic information, and/or other measurement data and other parameters of interest. As described below, the static and dynamic measurements may be analyzed and used to generate models of the subterranean formation to determine characteristics thereof. Similar measurements may also be used to measure changes in formation aspects over time.

The subterranean structure 204 has a plurality of geological formations 206*a*-206*d*. As shown, this structure has several formations or layers, including a shale layer 206*a*, a carbonate layer 206*b*, a shale layer 206*c* and a sand layer 206*d*. A fault 207 extends through the shale layer 206*a* and the carbonate layer 206*b*. The static data acquisition tools are adapted to take measurements and detect characteristics of the formations.

While a specific subterranean formation with specific geological structures is depicted, it will be appreciated that oilfield 200 may contain a variety of geological structures and/or formations, sometimes having extreme complexity. In some locations, for example below the water line, fluid may occupy pore spaces of the formations. Each of the measurement devices may be used to measure properties of the formations and/or its geological features. While each acquisition tool is shown as being in specific locations in oilfield 200, it will be appreciated that one or more types of measurement may be taken at one or more locations across one or more fields or other locations for comparison and/or analysis.

With the oilfield context in mind, an example system and method for identifying wellsite targets begins with determining an opportunity index for an area in a reservoir based on at least one of corresponding reservoir properties. The reservoir property may include a rock property, a structural property, and/or another type of reservoir property. The rock property may include porosity (PORO), permeability, mobile oil saturation, pressure, etc. The structural property may include a connected volume, formation thickness, width, etc. The rock properties and structural properties may be orthogonal or independent of each other to a large extent since expectations on rock properties may often depend on factors such as operating cost, oil price, and well cost whereas certain geometric requirements on robust well targets may be expected to be more universal.

Figure 3:
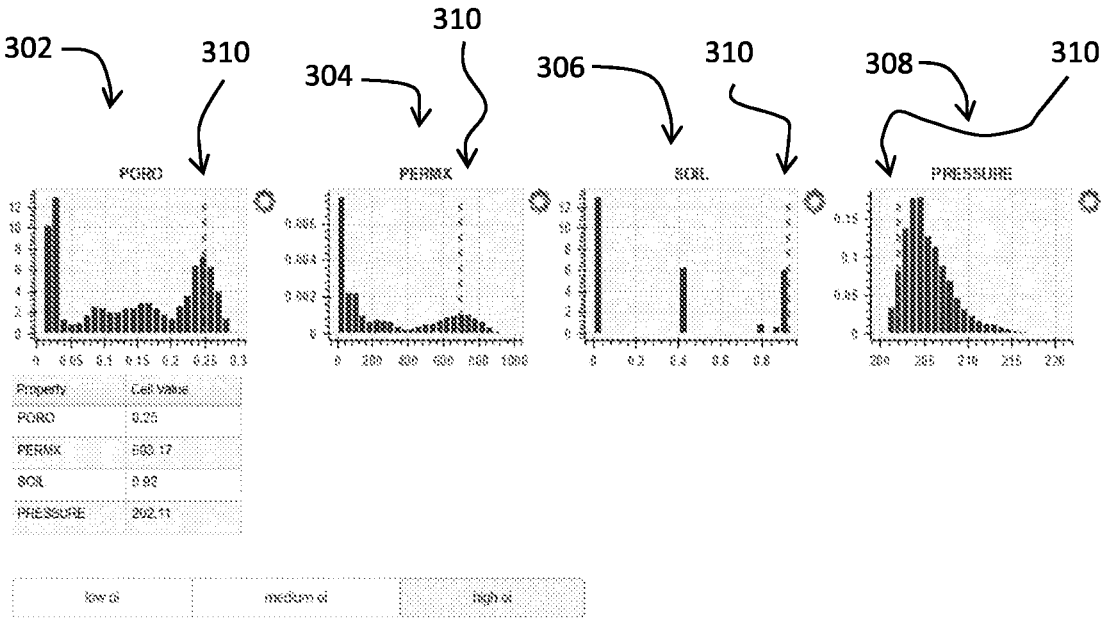
FIG. 3 illustrates an example of distribution of reservoir properties for an area of a reservoir, in accordance with some embodiments.

FIG. 3 illustrates an example of a distribution of reservoir properties for an area of a reservoir defined within a wellsite, in accordance with some embodiments. A reservoir area may be of various regular or irregular shapes, and may be of various sizes, e.g. 100 meters by 100 meters, 200 meters by 200 meters, and the like. For the method to learn what property values and combinations thereof make a better reservoir rock, a user may be asked for a given development scenario. The example histograms 302-308 in FIG. 3 show the distribution over the reservoir, and the dotted line 310 and the table provided may indicate the value to be rated by the user. The user may rate the value to be one of low, medium, and/or high.

As shown in FIG. 3, each of the histograms 302-308 are associated with the following reservoir properties: (1) porosity (PORO), (2) permeability in X-direction (PERMX), (3) soil, and (4) pressure are for a given reservoir area in this example. The dotted lines 310 for the four reservoir properties, PORO, PERMX, soil, and pressure, point to 0.25, 693.17, 0.92, and 202.11, respectively. A user may be requested to provide a rating for each of the four reservoir properties, e.g., as one of low, medium, or high. The value of a reservoir property to be rated by a user may be chosen manually, e.g., by a system administrator or automatically.

In some embodiments, other reservoir properties besides those explained herein may be used.

In some embodiments, the user may manually enter a rating for each of the reservoir properties to a computer system via a user interface.

In some implementations, the ratings are decided by a machine learning algorithm based on trained data associated with the reservoir. In some embodiments, the machine learning algorithm automatically enters each of the ratings of the reservoir properties.

Figure 4:
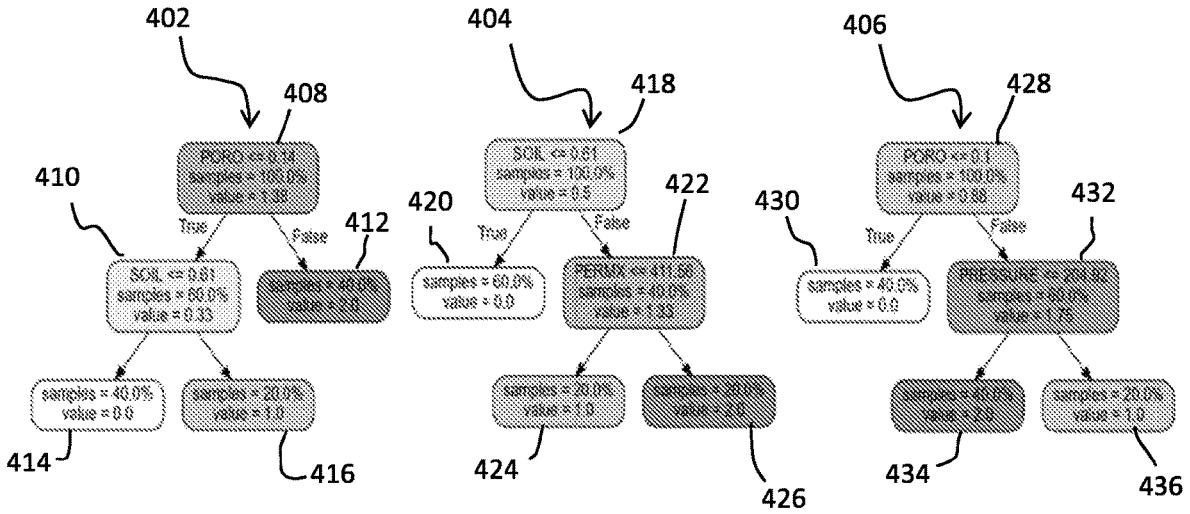
FIG. 4 illustrates examples of decision trees for generating an opportunity index for a reservoir area, in accordance with some embodiments.

FIG. 4 illustrates examples of decision trees 402-406 for generating an opportunity index for a reservoir area, in accordance with some embodiments. The decision trees 402-406 may be part of a model that could be an interpretable ensemble decision tree regressor, and a subset of the learned trees is shown here. As shown in FIG. 4, a decision tree 402 begins with an example where a root node 408 has 100% of the samples being considered and a PORO value of less than 0.14, where a base opportunity index of 1.38 is returned. When the conditions in the root node 408 are true, the decision path goes to child node 410 of root node 408 when 60% of the samples are considered and the soil value is less than 0.61, where an intermediate opportunity index of 0.33 is returned. On the other hand, when the conditions in root node 408 are false, the decision path goes to child node 412 of root node 408 when 40% of the samples are considered, where an opportunity index of 2.0 is returned. When the conditions in the child node 410 are true, the decision path goes to child node 414 of root node 408 when 40% of the samples are considered, where an intermediate opportunity index of 0 is returned. In addition, when the conditions in child node 410 are false, the decision path goes to child node 416 of root node 408 when 20% of the samples are considered, where an opportunity index of 1.0 is returned.

Moreover, FIG. 4 shows a decision tree 404 where a root node 418 has 100% of the samples being considered and a soil value of less than 0.61, where a base opportunity index of 0.5 is returned. When the conditions in root node 418 are true, the decision path goes to child node 420 of root node 418 when 60% of the samples are considered, where an intermediate opportunity index of 0 is returned. On the other hand, when the conditions in root node 418 are false, the decision path goes to child node 422 of root node 418 when 40% of the samples are considered, where an intermediate opportunity index of 1.33 is returned. When the conditions in the child node 422 are true, the decision path goes to child node 424 of root node 418 when 20% of the samples are considered, where an intermediate opportunity index of 1.0 is returned. In addition, when the conditions in child node 422 are false, the decision path goes to child node 426 of root node 418 when 20% of the samples are considered, where an opportunity index of 2.0 is returned.

In addition, FIG. 4 shows a decision tree 406 where a root node 428 has 100% of the samples being considered and a PORO value of less than 0.1, where a base opportunity index of 0.88 is returned. When the conditions in root node 428 are true, the decision path goes to child node 430 of root node 428 when 60% of the samples are considered, where an intermediate opportunity index of 0 is returned. On the other hand, when the conditions in root node 428 are false, the decision path goes to child node 432 of root node 428 when 60% of the samples are considered and a pressure value is less than 202.42, and further where an intermediate opportunity index of 1.75 is returned. When the conditions in the child node 432 are true, the decision path goes to child node 434 of root node 428 when 40% of the samples are considered, where an intermediate opportunity index of 1.0 is returned. In addition, when the conditions in child node 432 are false, the decision path goes to child node 436 of root node 428 when 20% of the samples are considered, where an opportunity index of 1.0 is returned.

An opportunity index may be assigned values of 0 (low), 1.0 (medium), or 2.0 (high) (or any number there between) in this embodiment, but other values may be used in other embodiments besides those discussed herein.

In some embodiments, user input may be used to train and/or improve the decision tree(s), e.g., by changing the root node or child node conditions, by changing the opportunity index(es), or in some other manner.

In some implementations, the opportunity indexes are decided upon by a machine learning algorithm based on trained data associated with the reservoir. In some embodiments, the machine learning algorithm automatically enters each of the opportunity indexes of the reservoir properties.

In some embodiments, the decision trees 402-406 may be built top-down from a root node and via partitioning the reservoir property values into subsets that contain instances with similar values. In some embodiments, standard deviation is used to calculate the homogeneity of a numerical sample. If the numerical sample is completely homogeneous, its standard deviation is zero.

In some embodiments, decision trees 402-406 are constructed by finding the attribute that returns the highest standard deviation reduction.

In some embodiments, decision trees 402-406 may be a supervised machine learning model used to predict a target by learning decision rules from features of the reservoir properties.

In some embodiments, decision trees 402-406 may be defined by an objective function that maximizes the information gain at each node of the decision trees 402-406.

Methods according to the present disclosure may further include classifying a section of the reservoir based on at least one of its computed embedding space, where the computed embedding space is a distance of the worst case embedding space in a neighborhood of the section, or a label of a neighbor in the neighborhood. The computed embedding space of the section may be defined by at least one of a number of opportunity indexes of areas in the section.

Figure 5:
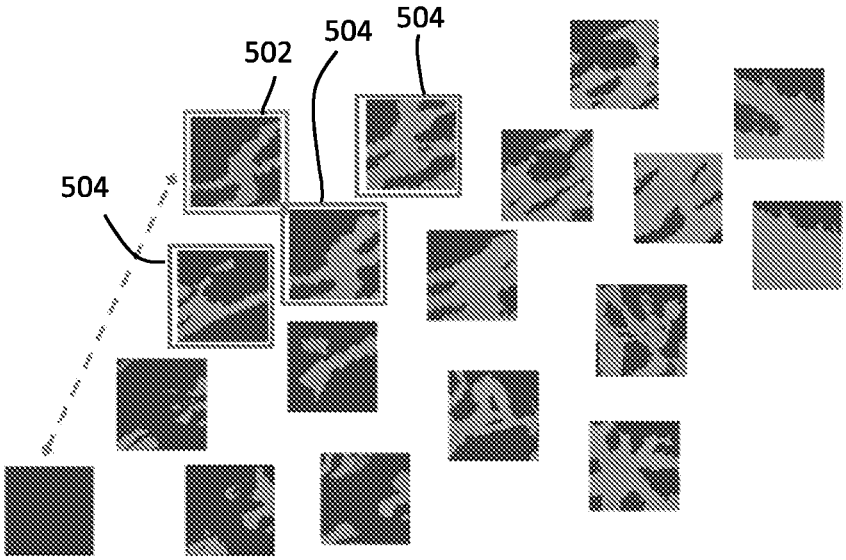
FIG. 5 illustrates an example of a classification model for determining an embedding space in a self-supervised manner, in accordance with some embodiments.

FIG. 5 illustrates an example of a classification model for determining an embedding space in a self-supervised manner, in accordance with some embodiments. A reservoir section or a cell may be of various regular or irregular shapes, and may be of various sizes, e.g. 1 kilometer by 1 kilometer, 2 kilometers by 2 kilometers, 50 kilometers by 50 kilometers, and the like. A section of the reservoir may be mapped to one of a poor, acceptable, or good drill target based on at least one computed embedding space.

As shown in FIG. 5, a new section 502 of a reservoir may be evaluated based on at least one of its computed embedding spaces, a distance to the worst-case embedding space as computed, or labels of its nearest neighbors 504 in the neighborhood. The computed embedding space of the section, as shown in FIG. 5, of the reservoir may be based on at least one of the opportunity indexes of areas within the section. A metric distance between points or sections in the embedding space may be a direct measure of structural similarity. In other words, a section may have similar structure(s) with its nearest neighbors.

The labels of the neighbors 504 may be provided by users to indicate whether or not a section or cell is a good candidate for drilling a well. In some embodiments, the classification model may be implemented as an ensemble classifier using a nearest-neighbor classification model based on user provided data points and a domain informed classification that "poor" targets are close (in the embedding space) to a slice of all-zeros opportunity index, "acceptable" targets are close to a slice of all-ones opportunity indexes, and "good" targets are close to a slice of all-twos opportunity indexes.

In some embodiments, the classification model may be implemented as a multi-label classification model having two or more class labels, where one or more class labels may be predicted for each example.

In some embodiments, the classification model may be implemented using a decision tree algorithm. In some embodiments, the classification model may be implemented using a Naive Bayes algorithm. In some embodiments, the classification model may be implemented using a Random Forest algorithm. In some embodiments, the classification model may be implemented using a Gradient Boosting algorithm.

In some embodiments, the classification model may follow a Multinoulli probability distribution having a discrete probability distribution or the like.

Figure 6:
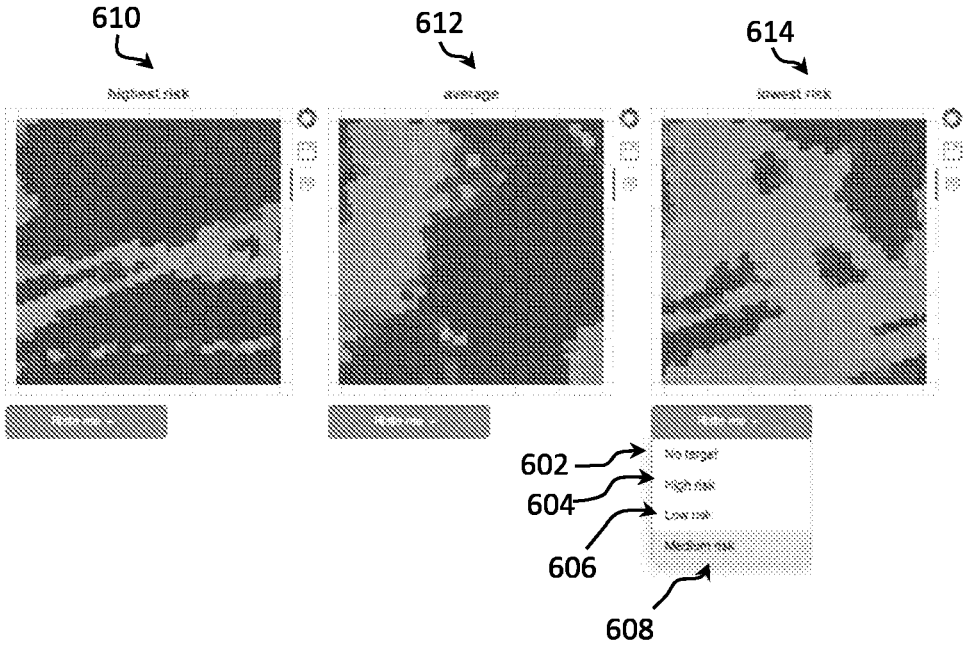
FIG. 6 illustrates an example of user-provided labels for data-points in the embedding space, in accordance with some embodiments.

FIG. 6 illustrates an example of user-provided labels for data-points or sections in the embedding space, in accordance with some embodiments. As shown, user-provided labels 602-608 for data-points or sections 610-614 in the embedding space may be collected when users disagree with the suggested classification. These labels 602-608 may then be used for future neighbor lookup.

Figure 7:
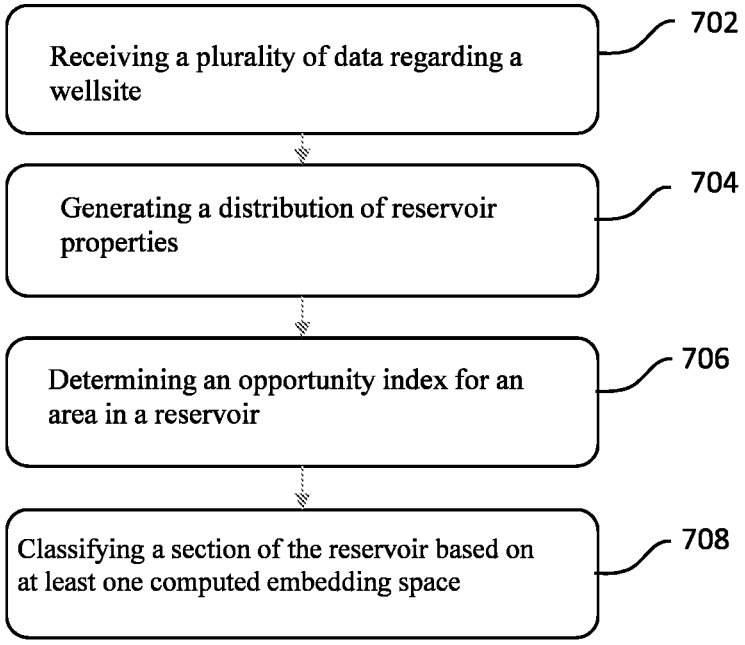
FIG. 7 is a process flow of a method for identifying a wellsite for drilling, in accordance with some embodiments.

FIG. 7 is a process flow 700 for a method for identifying a wellsite target for drilling. Process flow 700 begins by receiving a plurality of data regarding a wellsite using the systems described in FIGS. 1A-1C and FIG. 2, as shown in step 702. The method may include generating a distribution of reservoir properties for an area of a reservoir of interest for drilling, as shown in step 704. The distribution of reservoir properties may include generating histograms 302-308 associated with the reservoir properties, as discussed with respect to FIG. 3. Also, the method includes determining an opportunity index for an area in a reservoir based on at least one of corresponding reservoir properties, as shown in step 706. The opportunity index may be created using decision trees 402-406 of FIG. 4. Decision trees 402-406 may be part of a model that could be an interpretable ensemble decision tree regressor or other multi-class classification models described herein. Furthermore, the method includes classifying a section of the reservoir based on at least one computed embedding space, as shown in step 708. Step 708 involves implementing a classification model for determining an embedding space in a self-supervised manner, as discussed in FIG. 5.

Figure 8:
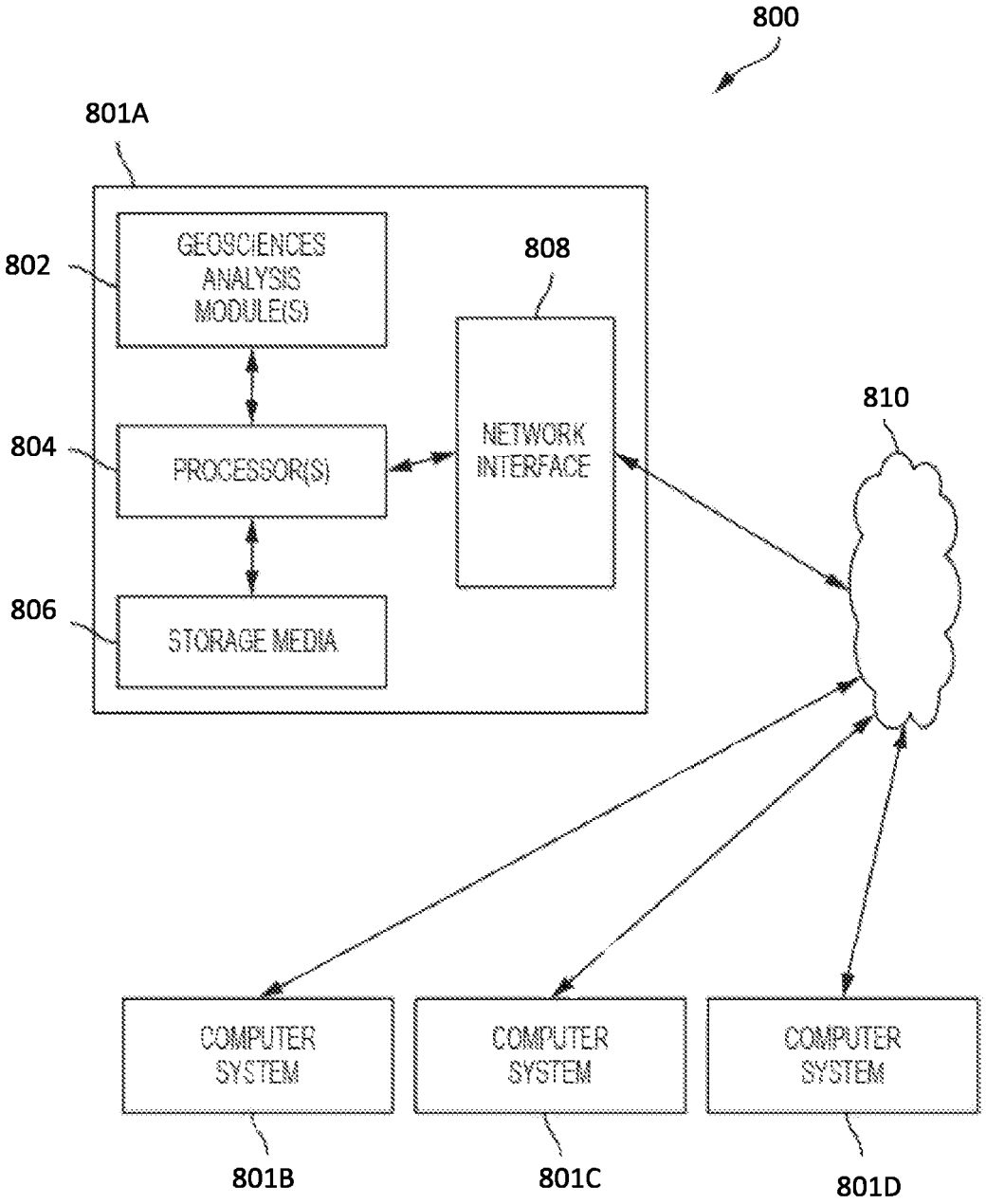
FIG. 8 depicts an example of a computing system for carrying out some of the methods of the present disclosure, in accordance with some embodiments.

FIG. 8 depicts an example computing system 800 in accordance with some embodiments. For example, the computing system may perform the method of FIG. 7 for identifying wellsite targets for drilling and the steps of generating a distribution of reservoir properties for an area of a reservoir of interest for drilling, and determining an opportunity index for an area in a reservoir based on at least one of corresponding reservoir properties. The computing system may further perform the method of classifying a section of the reservoir based on at least one computed embedding space, where the computed embedding of the section is based on at least one of opportunity indexes of areas in the section.

The computing system 800 can be an individual computer system 801A or an arrangement of distributed computer systems. The computer system 801A includes one or more geosciences analysis modules 802 that are configured to perform various tasks according to some embodiments, such as one or more methods disclosed herein. To perform these various tasks, geosciences analysis module 802 executes independently, or in coordination with, one or more processors 804, which is (or are) connected to one or more storage media 806. The processor(s) 804 is (or are) also connected to a network interface 808 to allow the computer system 801A to communicate over a data network 810 with one or more additional computer systems and/or computing systems, such as 801B, 801C, and/or 801D (note that computer systems 801B, 801C and/or 801D may or may not share the same architecture as computer system 801A, and may be located in different physical locations, e.g., computer systems 801A and 801B may be on a ship underway on the ocean, while in communication with one or more computer systems such as 801C and/or 801D that are located in one or more data centers on shore, other ships, and/or located in varying countries on different continents). Note that data network 810 may be a private network, or it may use portions of public networks, and it may include remote storage and/or applications processing capabilities (e.g., cloud computing).

A processor can include a microprocessor, microcontroller, processor module or subsystem, programmable integrated circuit, programmable gate array, or another control or computing device.

The storage media 806 can be implemented as one or more computer-readable or machine-readable storage media. Note that while in the example embodiment of FIG. 8 storage media 806 is depicted as within computer system 801A, in some embodiments, storage media 806 may be distributed within and/or across multiple internal and/or external parts of computing system 801A and/or additional computing systems. Storage media 806 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs), BluRays or any other type of optical media; or other types of storage devices. "Non-transitory" computer readable medium refers to the medium itself (i.e., tangible, not a signal) and not data storage persistency (e.g., RAM vs. ROM).

Note that the instructions or methods discussed above can be provided on one or more computer-readable or machine-readable storage medium, or alternatively, can be provided on multiple computer-readable or machine-readable storage media distributed in a large system having possibly plural nodes and/or non-transitory storage means. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions or located at a remote site from which machine-readable instructions can be downloaded over a network for execution.

It should be appreciated that computer system 801A is one example of a computing system, and that computer system 801A may have more or fewer components than shown, may combine additional components not depicted in the example embodiment of FIG. 8, and/or computer system 801A may have a different configuration or arrangement of the components depicted in FIG. 8. The various components shown in FIG. 8 may be implemented in hardware, software, or a combination of both, hardware and software, including one or more signal processing and/or application specific integrated circuits.

It should also be appreciated that while no user input/output peripherals are illustrated with respect to computer systems 801A, 801B, 801C, and 801D, many embodiments of computing system 800 include computing systems with keyboards, touch screens, displays, etc. Some computing systems in use in computing system 800 may be desktop workstations, laptops, tablet computers, smartphones, server computers, etc.

Further, the steps in the processing methods described herein may be implemented by running one or more functional modules in an information processing apparatus such as general-purpose processors or application specific chips, such as ASICs, FPGAs, PLDs, or other appropriate devices. These modules, combinations of these modules, and/or their combination with general hardware are included within the scope of this disclosure.

In some embodiments, a computing system is provided that comprises at least one processor, at least one memory, and one or more programs stored in the at least one memory, wherein the programs comprise instructions, which when executed by the at least one processor, are configured to perform any method disclosed herein.

In some embodiments, a computer readable storage medium is provided, which has stored therein one or more programs, the one or more programs comprising instructions, which when executed by a processor, cause the processor to perform any method disclosed herein.

In some embodiments, a computing system is provided that comprises at least one processor, at least one memory, and one or more programs stored in the at least one memory; and means for performing any method disclosed herein.

In some embodiments, an information processing apparatus for use in a computing system is provided, and that includes means for performing any method disclosed herein.

In some embodiments, a graphics processing unit is provided, and that includes means for performing any method disclosed herein.

These systems, methods, processing procedures, techniques, and workflows increase effectiveness and efficiency. Such systems, methods, processing procedures, techniques, and workflows may complement or replace conventional methods for identifying, isolating, transforming, and/or processing various aspects of data that may be collected from a subsurface region or other multi-dimensional space to enhance flow simulation prediction accuracy.

While various embodiments in accordance with the disclosed principles have been described above, it should be understood that they have been presented by way of example only and are not limiting.

Furthermore, the above advantages and features are provided in described embodiments but shall not limit the application of such issued claims to processes and structures accomplishing any or all of the above advantages.

The invention claimed is:

1. A method for identifying a wellsite target for drilling, the method comprising:

receiving, at a computing system, a plurality of data regarding a wellsite;

generating, at the computing system, a distribution of reservoir properties using the plurality of data for a plurality of areas of a reservoir defined within a section of the reservoir;

determining, at the computing system, a plurality of opportunity indexes for the plurality of areas of the reservoir based on a comparison of at least one of the corresponding reservoir properties to one or more conditions associated with one or more nodes of at least one decision tree, the one or more nodes being associated with the plurality of opportunity indexes;

automatically classifying, at the computing system, the section of the reservoir based on at least one computed embedding space, wherein the at least one computed embedding space is defined based on numbers of the plurality of opportunity indexes, wherein classifying the section of the reservoir is based on a location of the section within the at least one computed embedding space, and wherein the location of the section within the at least one computed embedding space is based on the plurality of opportunity indexes of the plurality of areas within the section of the reservoir;

identifying, at the computing system, the section of the reservoir as the wellsite target for drilling based on the classification of the section; and outputting, to a reservoir simulation model, an indication of the identified section of the reservoir as the wellsite target for drilling.

2. The method of claim 1, wherein generating the distribution of reservoir properties includes generating a distribution of rock properties.

3. The method of claim 2, wherein the rock properties comprise at least one of: porosity, permeability, mobile oil saturation, or pressure.

4. The method of claim 1, wherein the at least one decision tree is an interpretable ensemble decision tree regressor.

5. The method of claim 1, wherein the at least one decision tree is based on a supervised machine learning model used to predict the wellsite target by learning decision rules from features of the reservoir properties.

6. The method of claim 1, wherein classifying the section of the reservoir includes using a multi-class classification model.

7. The method of claim 6, wherein the multi-class classification model is an ensemble classifier using a nearest-neighbor classification model.

8. A system, comprising:

a processor configured to:

receive a plurality of data regarding a wellsite;

generate a distribution of reservoir properties using the plurality of data for a plurality of areas of a reservoir defined within a section of the reservoir;

determine a plurality of opportunity indexes for the plurality of areas in the reservoir based on a comparison of at least one of the corresponding reservoir properties to one or more conditions associated with one or more nodes of at least one decision tree, the one or more nodes being associated with the plurality of opportunity indexes;

automatically classify the section of the reservoir based on at least one computed embedding space, wherein the at least one computed embedding space is defined based on numbers of the plurality of opportunity indexes, wherein classifying the section of the reservoir is based on a location of the section within the at least one computed embedding space, and wherein the location of the section within the at least one computed embedding space is based on the plurality of opportunity indexes of the plurality of areas within the section of the reservoir;

identify the section of the reservoir as a wellsite target for drilling based on the classification of the section; and output, to a reservoir simulation model, an indication of the identified section of the reservoir as the wellsite target for drilling.

9. The system of claim 8, wherein the processor is configured to generate the distribution of reservoir properties by generating a distribution of rock properties.

10. The system of claim 9, wherein the rock properties comprise at least one of: porosity, permeability, mobile oil saturation, or pressure.

11. The system of claim 8, wherein the at least one decision tree is an interpretable ensemble decision tree regressor.

12. The system of claim 8, wherein the at least one decision tree is based on a supervised machine learning model used to predict a wellsite target by learning decision rules from features of the reservoir properties.

13. The system of claim 8, wherein the processor is configured to classify the section of the reservoir using a multi-class classification model.

14. The system of claim 13, wherein the multi-class classification model is an ensemble classifier using a nearest-neighbor classification model.

15. A method for developing information regarding a wellsite target for drilling, the method comprising:

receiving, at a computing system, a plurality of data regarding a wellsite;

developing, at the computing system, a distribution of reservoir properties for a plurality of areas of a reservoir defined within a section of the reservoir;

utilizing, at the computing system, a first model to determine a plurality of opportunity indexes for the plurality of areas of the reservoir based on a comparison of at least one of the corresponding reservoir properties to one or more conditions associated with one or more nodes of at least one decision tree, the one or more nodes being associated with the plurality of opportunity indexes;

employing, at the computing system, a second model to automatically classify the section of the reservoir based on at least one computed embedding space, wherein the at least one computed embedding space is defined based on numbers of the plurality of opportunity indexes, wherein classifying the section of the reservoir is based on a location of the section within the at least one computed embedding space, and wherein the location of the section within the at least one computed embedding space is based on the plurality of opportunity indexes of the plurality of areas within the section of the reservoir;

identifying, at the computing system, the section of the reservoir as the wellsite target for drilling based on the classification of the section; and outputting, to a reservoir simulation model, an indication of the identified section of the reservoir as the wellsite target for drilling.

16. The method of claim 15, wherein developing the distribution of reservoir properties includes developing a distribution of rock properties.

17. The method of claim 15, wherein utilizing the first model includes utilizing a supervised machine learning model used to predict the wellsite target by learning decision rules from features of the reservoir properties.

18. The method of claim 15, wherein employing the second model includes classifying the section of the reservoir using a multi-class classification model.

19. The method of claim 1, wherein automatically classifying the section of the reservoir based on the location of the section within the at least one computed embedding space comprises classifying the section of the reservoir based on metric distance of the location of the section within the at least one computed embedding space to one or more locations of one or more other sections within the at least one computed embedding space.

* * * * *